US005482674A

United States Patent [19]

Kosa et al.

[11] Patent Number: 5,482,674

[45] Date of Patent: Jan. 9, 1996

[54] FREE-MACHINING AUSTENITIC STAINLESS STEEL

[75] Inventors: Theodore Kosa; John H. Magee, Jr., both of Reading; James W. Martin, Sinking Spring; Ronald P. Ney, Sr., Reading, all of Pa.

[73] Assignee: CRS Holdings, Inc., Wilmington, Del.

[21] Appl. No.: 271,199

[22] Filed: Jul. 7, 1994

[51] Int. Cl.[6] ..... C22C 38/40; C22C 38/60

[52] U.S. Cl. ..... 420/42; 420/49

[58] Field of Search ..... 420/42, 49

[56] References Cited

U.S. PATENT DOCUMENTS

| | | | |
|---|---|---|---|
| 3,902,898 | 9/1975 | Denhard, Jr. et al. . | |
| 4,613,367 | 9/1986 | Eckenrod et al. | 420/42 |
| 4,784,828 | 11/1988 | Eckenrod et al. . | |
| 4,933,142 | 6/1990 | Haswell, Jr. et al. . | |
| 4,994,122 | 2/1991 | DeBold et al. . | |

OTHER PUBLICATIONS

*"Residual and Minor Elements in Stainless Steels", Handbook of Stainless Steels,* (1977), pp. 14–2, 14–3, 14–6, 14–7.

*"Material Specifications: Type 303 Hot Rolled Annealed Rod"*, Illini Wire Mill, Inc., Rev. #1 (Oct. 10, 1991).

G. O. Rhodes, J.J. Eckenrod and K. E. Pinnow, "A New High Manganese Free–Machining Austenitic Stainless Steel", *Proceedings of a Conference on Manganese Containing Stainless Steels held in conjunction with ASM's Materials Week* '87, 10–15, Oct. 1987, pp. 53–59.

*Primary Examiner*—Deborah Yee

*Attorney, Agent, or Firm*—Dann, Dorfman, Herrell and Skillman

[57] ABSTRACT

An austenitic, stainless steel alloy having a unique combination of machinability and a low magnetic permeability, especially in the cold worked condition, is disclosed consisting essentially of, in weight percent, about

| | |
|---|---|
| C | 0.1035 max |
| Mn | 1.0–4.0 |
| Si | 1.0 max |
| P | 0.2 max |
| S | 0.15–0.45 |
| Cr | 16.0–20.0 |
| Ni | 9.2–12.0 |
| Mo | 1.5 max |
| Cu | 0.8–2.0 |
| N | 0.035 max |
| Se | 0.1 max |

with the balance essentially iron.

13 Claims, No Drawings

FREE-MACHINING AUSTENITIC STAINLESS STEEL

FIELD OF THE INVENTION

The present invention relates to an austenitic stainless steel alloy and in particular to a resulfurized austenitic stainless steel alloy, and an article made therefrom, having a unique combination of corrosion resistance, machinability and low magnetic permeability, especially in the cold worked condition.

BACKGROUND OF THE INVENTION

In general, stainless steels are more difficult to machine than carbon and low-alloy steels because stainless steels have high strength and work-hardening rates compared to the carbon and low alloy steels. Consequently, it is necessary to use higher powered machines and lower machining speeds for machining the known stainless steels than for machining carbon and low-alloy steels. In addition, the useful life of a machining tool is often shortened when working with the known stainless steels.

In order to overcome the difficulties in machining the known stainless steels, some grades of stainless steels have been modified by the addition of elements such as sulfur, selenium, phosphorus, or lead. For example, AISI Type 303 stainless steel is a resulfurized, austenitic stainless steel having the following composition in weight percent:

| | wt. % |
|---|---|
| C | 0.15 max |
| Mn | 2.00 max |
| Si | 1.00 max |
| P | 0.20 max |
| S | 0.15 min |
| Cr | 17.0–19.0 |
| Ni | 8.0–10.0 |
| Fe | Balance |

Type 303 stainless steel is known to be useful for applications which require good machinability and nonmagnetic behavior, in combination with good corrosion resistance. However, a need has arisen for an austenitic stainless steel having significantly better machinabiiity than Type 303 stainless steel, particularly under production-type machining operations such as on an automatic screw machine.

U.S. Pat. No. 4,784,828 (Eckenrod et al.) relates to a resulfurized Cr-Ni austenitic stainless steel in which the total amount of carbon plus nitrogen is restricted to 0.065 w/o max. The data presented in the patent appears to show that the alloy provides improved machinability in short term laboratory tests because of the restricted amount of carbon and nitrogen. However, it has been discovered that the alloy disclosed in the '828 patent has less than desirable machinability under production-type machining conditions such as are encountered on an automatic screw machine. Furthermore, an austenitic stainless steel in which the carbon and nitrogen are reduced as taught in the '828 patent, provides an undesirably high magnetic permeability, in the cold drawn condition.

Given the foregoing, it would be highly desirable to have an austenitic stainless steel that provides a better combination of magnetic permeability and machinability than is provided by the known austenitic stainless steels.

SUMMARY OF THE INVENTION

The problems associated with the known austenitic stainless steel alloys are solved to a large degree by an alloy in accordance with the present invention. The alloy according to the present invention is an austenitic stainless steel alloy that provides improved machinability compared to AISI Type 303 alloy while maintaining a low magnetic permeability, especially in the cold worked condition.

The broad, intermediate, and preferred compositional ranges of the austenitic stainless steel of the present invention are as follows, in weight percent:

| | Broad | Intermediate | Preferred |
|---|---|---|---|
| C | 0.035 max | 0.030 max | 0.025 max. |
| Mn | 1.0–4.0 | 1.0–2.0 | 1.0–2.0 |
| Si | 1.0 max | 0.5 max | 0.5 max |
| P | 0.2 max | 0.1 max | 0.1 max |
| S | 0.15–0.45 | 0.15–0.45 | 0.25–0.45 |
| Cr | 16.0–20.0 | 17.0–19.0 | 17.0–19.0 |
| Ni | 9.2–12.0 | 9.2–11.0 | 9.2–10.0 |
| Mo | 1.5 max | 0.75 max | 0.75 max |
| Cu | 0.79–2.0 | 0.79–2.0 | 0.79–1.0 |
| N | 0.035 max | 0.030 max | 0.025 max |
| Se | 0.1 max | 0.05 max | 0.05 max |

Within the above stated weight percent ranges, the elements Ni and Cu are balanced in accordance with the following relationship to ensure that the alloy provides the unique combination of machinability and low magnetic permeability that are characteristic of the alloy:

$$\%Ni+2(\%Cu)\leqq 10.25.$$

The balance of the alloy is essentially iron except for the usual impurities found in commercial grades of such steels and minor amounts of additional elements which may vary from a few thousandths of a percent up to larger amounts that do not objectionably detract from the desired combination of properties provided by this alloy.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, unless otherwise indicated, percent (%) means percent by weight.

DETAILED DESCRIPTION

In the alloy according to the present invention, carbon and nitrogen are each restricted to not more than about 0.035 w/o, better yet to not more than about 0.030 w/o, in order to benefit the machinability of this alloy. The best results are obtained when carbon and nitrogen are each restricted to not more than about 0.025 w/o. However, such low amounts of carbon and nitrogen result in reduced stability of the austenitic microstructure and increased magnetic permeability when the alloy is cold worked.

Nickel and copper are present in this alloy at least partly to offset the adverse effect on magnetic permeability that results from the restricted amounts of carbon and nitrogen in the alloy. Nickel and copper are also present in the alloy because they promote the formation of austenite and benefit the machinability of the alloy. Accordingly, the sum of %Ni+2(%Cu) in this alloy is at least about 10.25 and at least about 9.2 w/o nickel is present in the alloy. Preferably, the alloy contains at least about 0.5 w/o copper.

Too much nickel and/or copper adversely affects the hot workability of this alloy. Moreover, the benefits realized from large amounts of nickel and copper are not commensurate with the additional cost of those elements in the alloy. Therefore, nickel is restricted to not more than about 12.0 w/o, preferably to not more than about 11.0 w/o. The best results are obtained when nickel is restricted to not more than about 10.0 w/o. Copper is restricted to not more than about 2.0 w/o, preferably to not more than about 1.0 w/o.

In the alloy according to the present invention, the elements C, N, Ni, and Cu are balanced to ensure that the alloy provides the unique combination of machinability and low magnetic permeability that is characteristic of this alloy. To that end, the best results are obtained when C and N are each restricted so as not to exceed the value of (%Ni+2(%Cu)–5)/175.

At least about 0.15 w/o, better yet at least about 0.25 w/o sulfur is present in this alloy because of sulfur's beneficial effect on machinability. However, the sulfur content is preferably restricted to not more than about 0.45 w/o because too much sulfur is detrimental to the workability of this alloy. Further, more than about 0.30 w/o sulfur adversely affects the quality of the surface finish of parts machined from this alloy. Accordingly, for applications requiring a high quality surface finish the sulfur content is restricted to not more than about 0.30 w/o.

At least about 1.0 w/o manganese is present to promote the formation of manganese-rich sulfides which benefit machinability. An excessive manganese content impairs corrosion resistance, so manganese is restricted to not more than about 4.0 w/o, preferably to not more than about 2.0 w/o.

At least about 16.0 w/o, preferably at least about 17.0 w/o, chromium is present in the alloy to enhance the alloy's general corrosion resistance and to help maintain low magnetic permeability when the alloy is cold worked. Excessive chromium can result in the formation of ferrite, so chromium is restricted to not more than about 20.0 w/o, preferably to not more than about 19.0 w/o.

Up to about 1.0 w/o silicon can be present in the alloy from deoxidizing additions during melting. Silicon is preferably limited to not more than about 0.5 w/o because it strongly promotes ferrite formation, particularly with the very low carbon and nitrogen present in this alloy.

Up to about 1.5 w/o molybdenum can be present in the alloy to enhance corrosion resistance. However, molybdenum is preferably limited to not more than about 0.75 w/o because it too promotes the formation of ferrite.

Up to about 0.2 w/o phosphorus can be present in the alloy to improve the quality of the surface finish of parts machined from this alloy. Preferably, phosphorus is limited to not more than about 0.1 w/o because phosphorus tends to cause embrittlement and adversely affects the machinability of this alloy as measured by machine tool life.

Up to about 0.1 w/o, but preferably not more than about 0.05 w/o, selenium can be present in this alloy for its beneficial effect on machinability as a sulfide shape control element.

Up to about 0.01 w/o calcium can be present in this alloy to promote formation of calcium-aluminum-silicates which benefit the alloy's machinability with carbide cutting tools.

A small but effective amount of boron, about 0.0005–0.01 w/o, can be present in this alloy for its beneficial effect on hot workability.

No special techniques are required in melting, casting, or working the alloy of the present invention. Arc melting followed by argon-oxygen decarburization is the preferred method of melting and refining, but other practices can be used. In addition, this alloy can be made using powder metallurgy techniques, if desired. This alloy is also suitable for continuous casting techniques.

The alloy of the present invention can be formed into a variety of shapes for a wide variety of uses and lends itself to the formation of billets, bars, rod, wire, strip, plate, or sheet using conventional practices.

The alloy of the present invention is useful in a wide range of applications. The superior machinability of the alloy lends itself to applications requiring the machining of parts, especially using automated machining equipment. In addition, the low magnetic permeability of the alloy makes the alloy beneficial in applications where magnetic interference cannot be tolerated, such as in computer components.

EXAMPLES

In order to demonstrate the unique combination of properties provided by the present alloy, Examples 1 and 2 of the alloy of the present invention having the compositions in weight percent shown in Table 1 were prepared. For comparison purposes, comparative Heats A–C with compositions outside the range of the present invention were also prepared. Their weight percent compositions are also included in Table 1.

TABLE 1

| Ex./Ht. No. | C | Mn | Si | P | S | Cr | Ni | Mo | Cu | N | % Ni + 2 (% Cu) |
|---|---|---|---|---|---|---|---|---|---|---|---|
| 1 | 0.022 | 1.61 | 0.63 | 0.035 | 0.33 | 17.56 | 9.23 | 0.35 | 0.79 | 0.020 | 10.81 |
| 2 | 0.021 | 1.60 | 0.64 | 0.035 | 0.33 | 17.55 | 9.79 | 0.35 | 0.79 | 0.020 | 11.37 |
| A | 0.061 | 1.60 | 0.64 | 0.035 | 0.32 | 17.57 | 8.72 | 0.35 | 0.28 | 0.044 | 9.28 |
| B | 0.022 | 1.60 | 0.64 | 0.033 | 0.31 | 17.61 | 8.71 | 0.35 | 0.29 | 0.020 | 9.29 |
| C | 0.021 | 1.61 | 0.64 | 0.036 | 0.32 | 17.68 | 9.29 | 0.35 | 0.28 | 0.020 | 9.85 |

Alloy A is representative of AISI Type 303 alloy. Alloy B is representative of the alloy disclosed in Eckenrod et al. and, in particular, does not differ significantly from Heat V569 in Table I of the Eckenrod patent. Alloy C is an alloy with the value of (%Ni+2(%Cu)) outside the range of the alloy of the present invention.

The Examples 1 and 2 and the comparative Heats A–C were prepared from 400 lb. heats which were melted under argon cover and cast as 7.5 in. (190.5 mm) square ingots. The ingots were pressed to 4 in. (101.6 mm) square billets from a temperature of 2300 F. (1260° C.). The billets were ground to remove surface defects and the ends were cut off. The billets were processed to bars by hot rolling to a diameter of 0.719 in. (18.3 mm) from a temperature of 2350 F. (1290° C.) and cut to lengths of about 12 ft. (365.8 cm). The round bars were turned to a diameter of 0.668 in. (17.0 mm) to remove surface defects and pointed for cold drawing. The round bars were annealed at 1950 F. (1065° C.) for 0.5 hours and water quenched. The annealed bars were cold drawn to 0.637 in. (16.2 mm), straightened, and then ground to 0.625 in. (15.9 mm).

To evaluate machinability, Examples 1 and 2 and comparative Heats A–C were tested on an automatic screw machine. A first form tool was used to machine the 0.625 in. (15.9 mm) diameter bars at a speed of 185 sfpm to provide parts having a contoured surface defined by a small diameter of 0.392 in. (10.0 mm) and a large diameter of 0.545 in. (13.8 mm). The large diameter is then finished, using a second or finishing form tool, to a diameter of 0.530 in. (13.5 mm). As a consequence of gradual wear induced on the first form tool by the machining process, the small diameter of the machined parts gradually increases. The tests were terminated when a 0.003 in. (0.076 mm) increase in the small diameter of the machined parts was observed. Improved machinability is demonstrated when a significantly higher number of parts is machined compared to a reference material.

The results of the machinability tests are shown in Table 2 as the number of parts machined (#of Parts). Each alloy was tested in three separate runs. The weight percents of nickel, copper, carbon, and nitrogen for each composition tested are included in Table 2 for convenient reference. Also shown in Table 2 are the range limits for the magnetic permeabilities (μ) of the compositions as determined at the surface of the cold drawn bars by the Severn Gage.

TABLE 2

| Ex./Ht. No. | Ni | Cu | C | N | No. of Parts | Magnetic Permeability (μ) |
|---|---|---|---|---|---|---|
| 1 | 9.23 | 0.79 | 0.022 | 0.020 | 360<br>420<br>340 | $1.1 < \mu < 1.2$ |
| 2 | 9.79 | 0.79 | 0.021 | 0.020 | 360<br>380<br>430 | $1.05 < \mu < 1.1$ |
| A | 8.72 | 0.28 | 0.061 | 0.044 | 120<br>140<br>140 | $1.1 < \mu < 1.2$ |
| B | 8.71 | 0.29 | 0.022 | 0.020 | 170<br>140<br>150 | $4.0 < \mu < 6.0$ |
| C | 9.29 | 0.28 | 0.021 | 0.020 | 300<br>250<br>280 | $1.8 < \mu < 2.0$ |

The data in Table 2 clearly show the superior machinability of Examples 1 and 2 compared to Heats A and B. Moreover, the data of Table 2 show that Examples 1 and 2 also provide the desirably low magnetic permeability that is characteristic of the nominal composition of the Type 303 alloy, exemplified by Heat A. In summary, the data in Table 2 demonstrate the unique combination of machinability and low magnetic permeability provided by the alloy according to the present invention.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. An austenitic, stainless steel alloy having a good combination of machinability and a low magnetic permeability consisting essentially of, in weight percent, about

| | |
|---|---|
| C | 0.035 max |
| Mn | 1.0–2.0 |
| Si | 1.0 max |
| P | 0.2 max |
| S | 0.15–0.45 |
| Cr | 16.0–20.0 |
| Ni | 9.2–12.0 |
| Mo | 1.5 max |
| Cu | 0.79–2.0 |
| N | 0.035 max |
| Se | 0.1 max |

the balance essentially iron.

2. The alloy as recited in claim 1 which contains no more than about 0.030 w/o each of carbon and nitrogen.

3. The alloy as recited in claim 1 which contains no more than about 0.025 w/o carbon.

4. The alloy as recited in claim 1 which contains no more than about 0.02 w/o carbon.

5. The alloy as recited in claim 1 which contains up to about 11.0 w/o nickel.

6. An austenitic, stainless steel alloy having a good combination of machinability and a low magnetic permeability consisting essentially of, in weight percent, about

| | |
|---|---|
| C | 0.030 max |
| Mn | 1.0–2.0 |
| Si | 0.5 max |
| P | 0.1 max |
| S | 0.15–0.45 |
| Cr | 17.0–19.0 |
| Ni | 9.2–11.0 |
| Mo | 0.75 max |
| Cu | 0.79–2.0 |
| N | 0.030 max |
| Se | 0.05 max |

the balance essentially iron.

7. The alloy as recited in claim 6 which contains not more than about 0.025 w/o each of carbon and nitrogen.

8. The alloy as recited in claim 6 which contains not more than about 0.02 w/o carbon.

9. The alloy as recited in claim 6 which contains up to about 10.0 w/o nickel.

10. The alloy as recited in claim 6 which contains not more than about 1.0 w/o copper.

11. An austenitic, stainless steel alloy having a good combination of machinability and a low magnetic permeability consisting essentially of, in weight percent, about

| | |
|---|---|
| C | 0.025 max |
| Mn | 1.0–2.0 |
| Si | 0.5 max |
| P | 0.1 max |

-continued

| | |
|---|---|
| S | 0.25–0.45 |
| Cr | 17.0–19.0 |
| Ni | 9.2–10.0 |
| Mo | 0.75 max |
| Cu | 0.79–1.0 |
| N | 0.025 max |
| Se | 0.05 max |

the balance essentially iron.

12. The alloy as recited in claim 11 which contains not more than about 0.02 w/o carbon.

13. The alloy as recited in claim 11 which contains at least about 9.5 w/o nickel.

* * * * *